US006365884B1

(12) United States Patent
Hanton

(10) Patent No.: US 6,365,884 B1
(45) Date of Patent: Apr. 2, 2002

(54) SEGMENTED COMPRESSED INDUCTION HEATING COIL ASSEMBLY

(75) Inventor: David J. Hanton, Vienna, OH (US)

(73) Assignee: Ajax Magnethermic Corporation, Warren, OH (US)

( * ) Notice: Subject to any disclaimer, the term of this patent is extended or adjusted under 35 U.S.C. 154(b) by 0 days.

(21) Appl. No.: 09/451,730

(22) Filed: Nov. 30, 1999

(51) Int. Cl.[7] ..... H05B 6/36
(52) U.S. Cl. ..... 219/672; 219/676
(58) Field of Search ..... 219/672, 676, 219/674, 618, 633, 420, 421, 424; 264/486; 29/611; 336/206; 373/78, 120, 144, 142; 432/156, 262, 264

(56) References Cited

U.S. PATENT DOCUMENTS

| | | | | | |
|---|---|---|---|---|---|
| 3,636,293 | A | * | 1/1972 | Schneider | 373/78 |
| 3,694,609 | A | * | 9/1972 | Kennedy | 219/633 |
| 4,060,692 | A | * | 11/1977 | Naastepad et al. | 373/156 |
| 4,321,444 | A | | 3/1982 | Davies | |
| 4,481,709 | A | * | 11/1984 | McDermott | 29/611 |
| 4,532,398 | A | | 7/1985 | Henriksson | |
| 4,585,916 | A | | 4/1986 | Rich | |
| 4,595,607 | A | * | 6/1986 | Betteridge et al. | 427/185 |
| 4,633,481 | A | * | 12/1986 | Schwenninger | 373/152 |
| 4,754,114 | A | | 6/1988 | Sommer et al. | |
| 4,761,530 | A | | 8/1988 | Scherer et al. | |
| 5,034,586 | A | | 7/1991 | Havas et al. | |
| 5,087,804 | A | * | 2/1992 | McGaffigan | 219/618 |
| 5,338,497 | A | * | 8/1994 | Murray et al. | 264/486 |
| 5,683,608 | A | * | 11/1997 | Matsen et al. | 219/676 |

* cited by examiner

*Primary Examiner*—Teresa Walberg
*Assistant Examiner*—Quang Van
(74) *Attorney, Agent, or Firm*—Fay, Sharpe, Fagan, Minnich & McKee, LLP

(57) ABSTRACT

An induction heating coil assembly including modular cast refractory blocks (10, 12, 14, 16) encasing copper turns (24, 26). The blocks are configured so that the segmenting between blocks occurs at locations where refractory cracks have been prone to occur. The turns, and additional support rods (42, 44), are placed in tension and fastened against the end walls of the refractory blocks to place the blocks under compression to the extent that normal gravitational forces tending to place the refractory blocks in tension are overcome by the compressive forces of the turns and rods.

23 Claims, 3 Drawing Sheets

SEGMENTED COMPRESSED INDUCTION HEATING COIL ASSEMBLY

BACKGROUND OF THE INVENTION

The subject invention pertains to the art of induction heating and more particularly, solenoidal coil assemblies cast in a refractory. The assembly is especially intended for heating unusually wide strips, sheets or slabs.

Inductive heating of slab or strip work pieces with solenoidal coils is well known. It is also well known to protect the coils from the work piece by encasing it in a cast refractory such as cement or the like. Such prior assemblies have suffered from the principal problem of being prone to crack and break. Voids within the refractory itself, as well as normally occurring tension risers, will expand the crack over time and ultimately require reconstruction or repair. The cracking can occur due to normally occurring vibration of the coil, as well as part collision or stress cracking occurring at tension points due to the weight of the refractory material itself When such cracks expose the turns to the work piece, the turns can be damaged to the extent that the system should no longer be operational.

Another problem with such systems is that the encasement of the entire coil within the refractory can inhibit repair because the inductive turns are no longer easily accessible due to the difficulty in separating them from the refractory or to the extent that the cracking of the refractory will impart some physical damage to the turn itself Yet another problem with such systems is when the inductive turns are encased in the refractory during the casting process, they become bound to the refractory. The binding causes the refractory and turn to vibrate together and sound levels created during the operating process can be very loud. In addition, the vibration of the bound refractory and turns enhance the prospects for refractory cracking.

In particular cases where extremely wide work pieces (even up to about 3½ meters wide) are being heated, the refractory can have a weight and span which can cause a bow and significant tension risers at cracks which can expand more quickly over time. In order to inhibit crack formation, it has been known to pretension the turns before refractory casting thereabout so that as the refractory hardens, the turns themselves which become bound to the refractory during the hardening process, can impart compressive forces on the refractory to counteract whatever tensioning forces may occur. A refractory under reasonable compression is much less likely to crack than a refractory under tension. However, this design embodiment, wherein the turns and refractory are bound together, has problems with quicker deterioration due to the direct communication of vibration from the turns to the refractory and the varying rates of thermal expansion between them during the repetitive heating and cooling of the induction heating operation. In addition, such assemblies also retain the particular problems in repair and reconstruction due to the close and rigid contacting between the conductor turns and the refractory casing.

Design considerations for such inductive heating assemblies seek to minimize the opportunity and likelihood for crack formations and still provide an assembly which is easily constructed, serviced and operated.

The subject invention comprises a new inductive heating assembly which overcomes the above referenced problems and others and which provides a rigid construction despite an unusually large solenoidal opening, facilitates ease of repair, reduces sound pollution during the coil operating periods, is efficient in operation and provides enhanced cost effectiveness.

BRIEF SUMMARY OF THE INVENTION

In accordance with the present invention, there is provided an induction heating coil assembly comprising a plurality of copper turns encased in a refractory casing wherein the turns are loosely disposed within refractory cavities and are tensioned for maintaining the refractory in compression. The overall assembly is comprised of four major parts which are segmented to form a modular assembly. The segmenting is intended to occur where cracks are most likely to appear in a corresponding non-segmented assembly. The turns are disposed in top and bottom blocks with end connectors and jumpers extending out from the ends of the blocks for selective connection with the turns on the opposed bottom block. The top and bottom blocks are spaced by the end blocks.

In accordance with another aspect of the present invention, a compression rod is also disposed within the casting generally parallel to the turns and is also tensioned for enhancing the compression forces on the top and bottom blocks.

In accordance with yet another aspect of the present invention, the refractory holes or cavities accommodating the copper turns and compression rod are sized to accommodate a spacing between the refractory and the turn or rod for a nonbinding loose disposition within the hole or cavity to better accommodate vibrations and thermal expansions.

In accordance with another aspect of the invention, a method is disclosed for assembling the modular coil assembly.

An important benefit of the subject invention is a modular induction heating coil assembly which especially inhibits crack formation in an unusually wide solenoid opening for the coil assembly.

Another benefit of the present invention is the modular assembly in a coil which provides a rigid construction for the top and bottom refractory blocks and which inhibits gravitational forces from placing the block in a tension stress and thereby minimizes the likelihood of stress cracks occurring.

A further benefit of the present invention is an assembly wherein turns or compression rods may be easily removed, repaired or adjusted from an encasing refractory material. In addition, the assembly provides improved reduction in sound from vibrations, improved efficiency of assembly and operation and consequential improvements in cost effectiveness.

Other benefits and advantages of the subject new induction coil assembly will become apparent to those skilled in the art upon a reading and understanding of this specification.

BRIEF DESCRIPTION OF THE DRAWINGS

The invention may take physical form in certain parts and arrangements of parts, the preferred embodiments of which will be described in detail in the specification and illustrated in the accompanying drawings which form a part hereof and wherein.

DETAILED DESCRIPTION OF THE INVENTION

Figure 1:
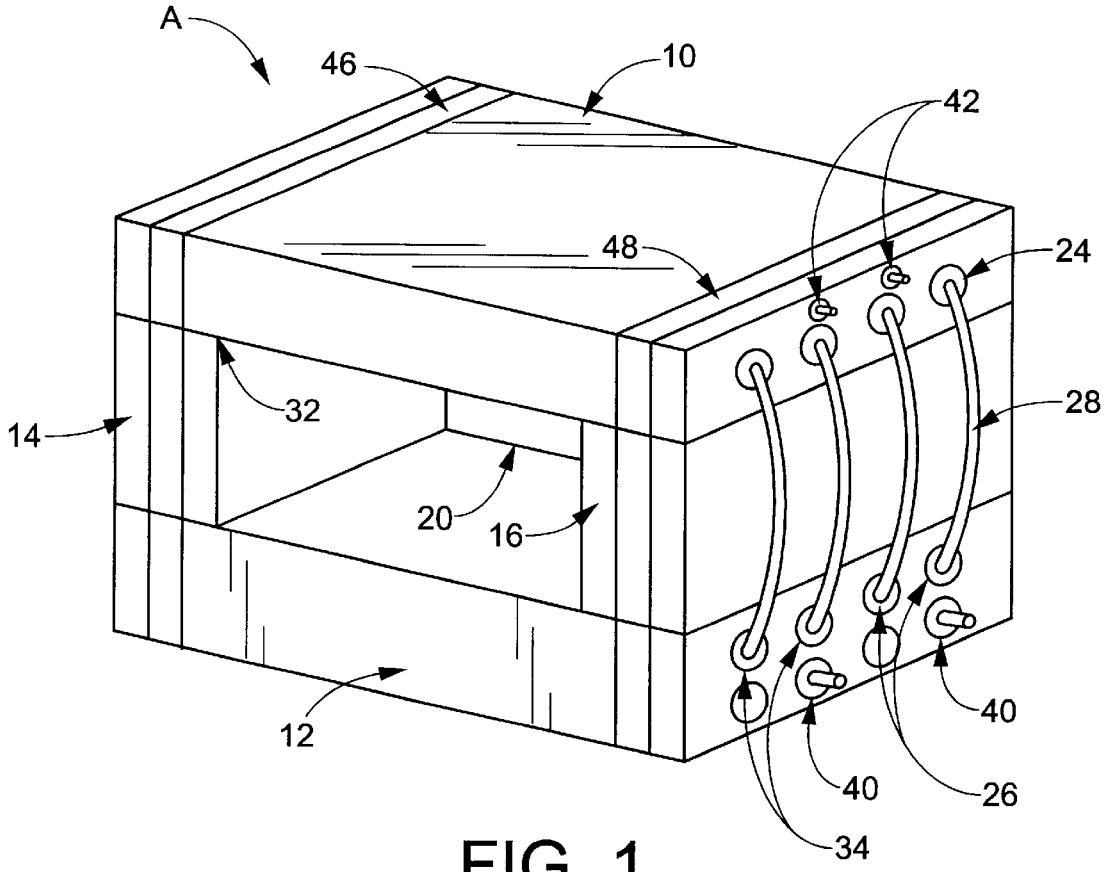
FIG. 1 is a perspective view of an induction heating coil assembly formed in accordance with the present invention.
Figure 3:
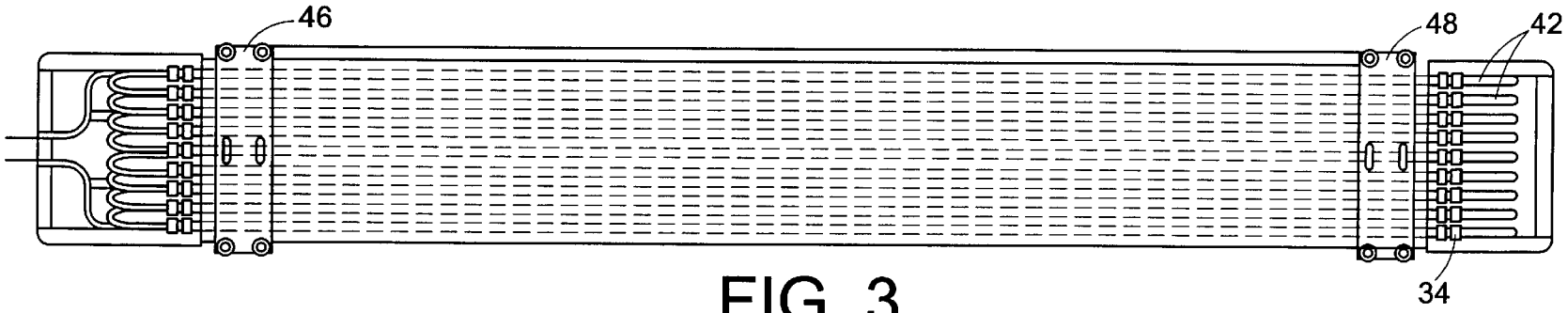
FIG. 3 is a top plane view thereof.
Figure 2A:
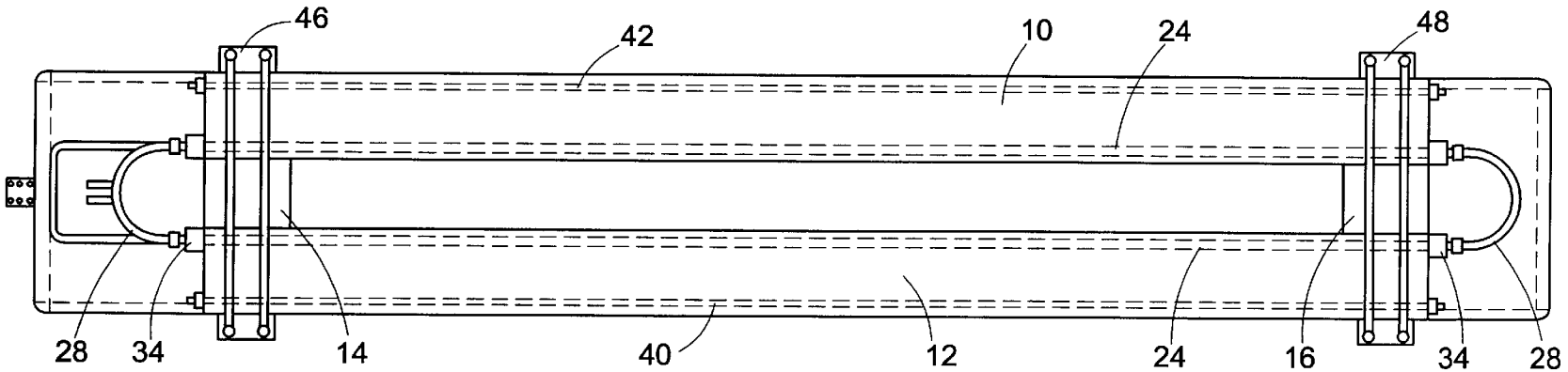
FIG. 2*a* is a side elevational view of an alternative embodiment thereof.
Figure 2B:
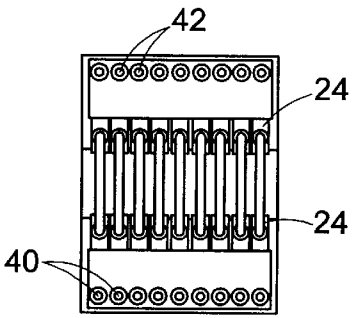
FIGS. 2*b* and 2*c* are end views of the embodiment of FIG. 2*a*.
Figure 2C:
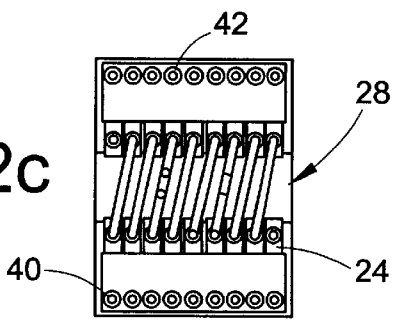

Referring now to the drawings wherein the showings are for purposes for illustrating the preferred embodiments of the invention only and not for purposes of limiting same, the assembly A is comprised of four principal parts, top and bottom blocks 10, 12 and two opposed end blocks 14, 16. The blocks all comprise refractory castings for insulating other coil components from work pieces being heated by the coil during passage through the solenoidal opening 20. The refractory itself is comprised of conventional materials.

The electrical coil encased in the refractory is comprised of a plurality of copper turns 24 in the top block 10, turns 26 in the bottom block 12 and connecting assemblies or jumpers 28 for communicating electrical energy therebetween. The turns 24, 26 are conventionally constructed as water-cooled copper conduits and are ultimately connected to the source of energy (not shown) for creating a high frequency magnetic field effect for inductively heating a work piece in a conventional manner.

There are two particular features of the assembly which are nonconventional. The first is the segmented or modular nature of the four principal components 10, 12, 14, 16. The interface or abutment area, e.g., interface surface 32, is disposed where cracking was prone to occur in non-segmented refractory casings. The modular nature of the components facilitates interchangeability, ease of assembly and ease of repair or reconstruction. The other feature is that the turns 24, 26 are put into rather high levels of tension to exert a compressive force on the respective refractory blocks 10, 12. More particularly, the end of the turns include springs (Bellville washers) 34 which are tightened down at each end of a turn to approximately 2,500 pounds of compressive force so that each block (10, 12) has approximately 25,000 pounds of compressing force. The amount of force applied to the turns is intended to overcome whatever tension forces are likely or which normally result on the blocks due to the gravitational forces of the weight of the block and its span. Keeping in mind that this particular construction is primarily intended for unusually large solenoidal openings 20, if the refractory block 10 were allowed to bow within the opening 20, the bottom portion of the block 10, i.e., that portion nearest the opening 20, would tend to bow so that tension forces on the bottom wall of the top block 10 would tend to cause cracks therein. However, the turns 24 generally disposed within the bottom portion of the block 10 exert such a compressive force that the block will remain in compression despite the gravitationally induced tensile forces. So long as the block 10 remains in compression the refractory will better avoid cracking. With reference to the bottom block 12, an additional advantageous feature is the inclusion of compression rods 40. As discussed above, tensile forces due to gravitational bowing will normally occur in the bottom portion of the blocks 10, 12, but the turns 24, 26 are disposed within the blocks generally nearer the wall defining the solenoidal opening 20. Thus, the compression rods 40 similarly tensioned as the turns 26 will impart compressor forces on the block 12 near the bottom wall so that block 12 in its entirety will remain under compression. Similar tensioning rods 42 are included in the top block 10, and even though not so necessary to satisfy the particular compression results required, (i.e., the top portion of block 10 will tend towards compression as opposed to tension), rods 42 are similarly included to facilitatte the modular construction of the assembly since now the top and bottom of blocks 10, 12 are identical constructions and can be interchanged as either the top and bottom blocks.

End blocks 14, 16 are a similarly constructed refractory and are disposed to space the top and bottom blocks from one another to define the desired sizing of the solenoid opening 20. The blocks can, of course, be dimensioned to whatever thickness an operator may desire. Clamps 46, 48 clamp the modular assembly together.

Another feature of the subject invention is the relative disposition of the stainless steel rods 40, 42 and copper turns 24, 26 within the refractory castings 10, 12. More particularly, both the rods and the copper conductors are unattached, i.e., loosely received, within the refractories 10, 12. There are several ways to accomplish this result, such as a special painting or coating of the rods before the casting of the refractory process; however, a presently preferred method is to coat the turns with wax or paraffin (not shown) prior to the casting. In other words, the refractory is essentially neutrally cast since the turns or rods are spaced from a binding refractory contact and cannot impart any tensile or compressive forces on the blocks absent the attachment of the compressive springs at their ends adjacent the end walls of the blocks 10, 12. Allowing the compression members, both the turns and the stainless rods, to be free of the casting provides a number of advantages. Relative axial movement between the refractory and the compression members is possible and can account for varying expansion rates. The copper turns 24, 26 are normally water-cooled, but since the rods 42, 44 are not they can be inductively heated. In addition, the refractories 10, 12 can be heated (or cooled) by ambient temperature as well as energy absorbed from the heated part. The varying expansion rates between the refractory and the compression members during the heating and cooling process, if the parts were bound to each other, can induce tension forces within the refractory that can cause cracking. Since the casting operation itself is not without imperfection, certain compression and tension risers can occur at locations within the casting where a previous weakness (i.e., void or any other kind of weakened spot) existed. The compression forces prevent any weakness from developing into a crack since the weakened area would never be exposed to tension forces.

The loose reception in the holes or cavities within the refractory of the turns permits the turns to vibrate, that is to move in a perpendicular motion relative to the axis of the turns, due to magnetic forces of the operating assembly. Such turn movement has minimal contact with the casting and thus the amount of vibrated energy transferred from each turn to the casting is reduced. The ancillary advantage to such an assembly is the lowering of the vibrational sound produced by the coil. Some such coils produce particularly loud and unpleasant vibrational noises and the reduction of sound pollution of the present invention is a readily appreciable operational advantage. An often desirable alternative feature is that the turns are additionally insulated. For example, prior to the encasing and wax coating, an insulating wrap, typically comprising a flexible glass fiber webbing is wrapped about the turns to provide some additional heat or electrical insulation protection to the turns. The wax coating is then applied on top of the wrapping.

The modular nature of the assembly is facilitated by optional electrical connection schemes, that is series or parallel turns between the turns and the upper and lower blocks. The connections can be adjusted at the time of assembly or use depending upon the operator's need.

For the eventual need to replace the refractory casting which occurs over time, due to part collision or normal wear, the turns 24, 26 and rods 40, 42 can be removed and reused either by installing them into a spare casting or by recasting them into a new casting. Also, in the event of a specific turn failure, the individual turn can be replaced within a casting due to the loose fitting of the turn within the casting cavity. Lastly, the modular nature of the assembly accommodates changing operational requirements. An increase or decrease in the coil opening 20 can be accomplished by replacing the separation blocks 14, 16 and jumpers 28. A reduction in coil width is accomplished by removing and shortening the turns 24, 26 and rods 40, 42, cutting the castings 10, 12 to shorter dimensions, and reinstalling the turns and rods.

Figure 4:
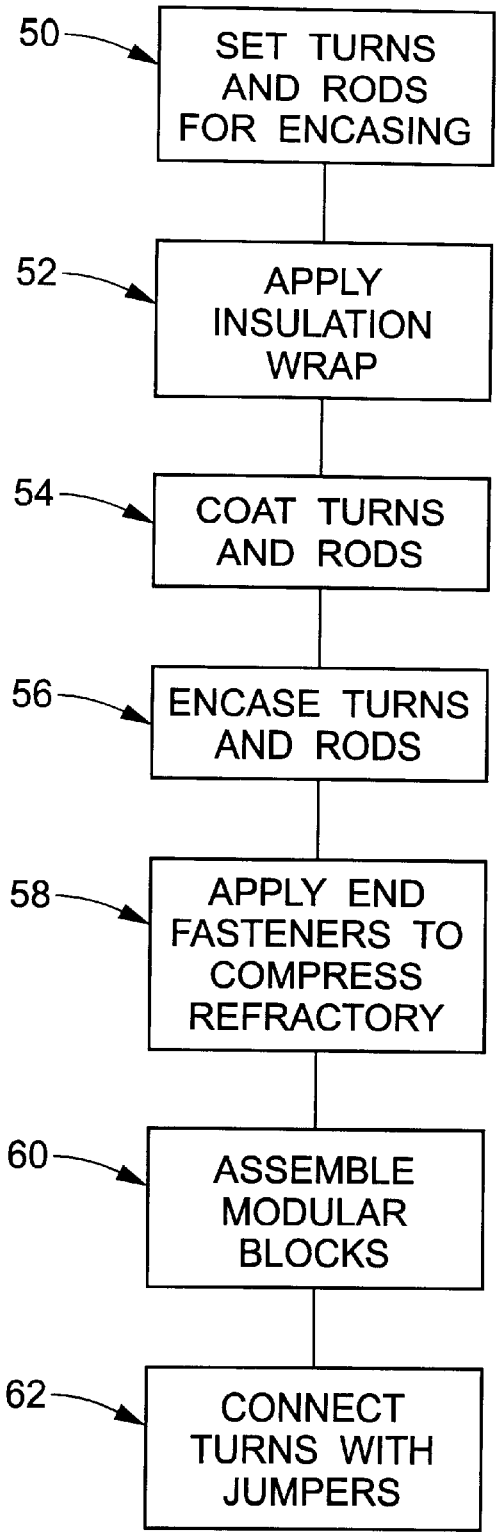
FIG. 4 is a flowchart illustrating the steps in manufacturing the subject assembly.

With particular attention to FIG. 4, the method steps for assembling the modular coil assembly A are explained. The rods and turns are first set for encasing in the refractory and are appropriately disposed within a mold (not shown), in which the refractory will set 50. If an insulation wrap about the turns is desired, then it is applied 52. The wax coating which will serve to space the turns and rods in the refractory cavities to avoid binding of the turns and rods to the refractory is next applied 54. The refractory material is then poured and allowed to dry so that the turns and rods are encased 56. After the refractory has fully dried, end fasteners suitable for tensioning the turns and rods are attached 58 and tightened down to apply the desired compressive force. The modular boxes are then assembled 60 in a manner to form a solenoidal coil such as shown in FIG. 1. Lastly, the turns are connected 62 with jumpers to form the circuit that is desired.

The invention has been described with reference to the preferred embodiments. Modifications and alterations will obviously occur to others upon a reading and understanding of this specification. It is our intention to include all such modifications and alterations as a part of this invention to the extend that they come within the scope of the appended claims.

Having thus described the invention, we now claim:

1. An induction heating coil assembly comprising:

a plurality of turns encased in a refractory wherein the turns are loosely disposed within refractory cavities and the turns are tensioned against the refractory for maintaining the refractory in compression.

2. The coil assembly as defined in claim 1 wherein tensioned rods are further disposed in the refractory for supplementally maintaining the refractory in compression.

3. The coil assembly as defined in claim 2 wherein the turns and rods are disposed within the refractory cavities being sized to accommodate a spacing between the turns, rods and the cavities for precluding a binding of the refractory to the turns and rods over intermediate lengths thereof.

4. The coil assembly as defined in claim 1 further comprising a modular assembly of refractory blocks including opposed top and bottom blocks and opposed first and second end blocks, the top and bottom blocks encasing the turns.

5. The coil assembly as defined in claim 1 including a spring associated with the turns at an end of the refractory and disposed for maintaining of the refractory in compression.

6. The coil assembly as defined in claim 4 wherein first and second end clamps are disposed about the top and bottom blocks and the first and second end blocks for clamping the assembly together.

7. The coil assembly as defined in claim 1 wherein an insulating wrap is disposed about the turns.

8. An induction heating coil assembly comprising:

a neutrally cast refractory;

a plurality of inductive turns encased within the refractory and having end connectors disposed for connection to a source of energy; and, intermediate the end connectors and end walls of the refractory, springs associated with the turns and the refractory end walls for compressing the refractory to a predetermined compression whereby gravitational forces on the refractory are unable to put the refractory into a tension and refractory cracks are inhibited.

9. The coil assembly as defined in claim 8 wherein the turns are disposed within refractory cavities sized to permit a spacing between the turns and the refractory whereby the turns are free of the casting for variable heat expansion and vibration.

10. The coil assembly as defined in claim 8 further including a compression rod disposed in parallel to the turns for enhancing compression forces on the refractory.

11. The coil assembly as defined in claim 8 wherein the refractory comprises a plurality of segmented blocks.

12. The coil assembly as defined in claim 11 wherein the segmented blocks comprise top and bottom blocks including the turns and first and second end blocks for spacing the top and bottom blocks.

13. The coil assembly as defined in claim 12 wherein turns in the top and bottom blocks are connected by an associated set of jumpers.

14. The coil assembly as defined in claim 8 wherein a coating is associated with the turns to insulate the turns and refractory from a binding relationship.

15. The coil assembly as defined in claim 14 wherein the coating comprises a wax.

16. The coil assembly as defined in claim 8 wherein an insulating wrap is disposed about the turns.

17. The coil assembly as defined in claim 16 wherein a wax coating is applied over the insulating wrap.

18. A method of manufacturing a coil assembly comprising a plurality of turns encased in a refractory wherein the turns are loosely disposed within refractory cavities and tensioned for maintaining the refractory in compression, comprising steps of:

disposing the plurality of turns for encasement in the refractory;

coating the turns with a coating that will space the turns from the refractory;

encasing the turns in the refractory;

fastening the turns at end portions adjacent refractory end walls; and compressing the refractory by tensioning the turns with the fasteners.

19. The method as defined in claim 18 further comprising disposing a tension rod for the encasing and the fastening also includes providing the fasteners on the tension rod for supplementing the compressing of the refractory.

20. The method as defined in claim 18 wherein the coating comprises applying a wax to the turns.

21. The method as defined in claim 18 including applying an insulating wrap to the turns prior to the coating.

22. The method as defined in claim 18 wherein the encasing comprises forming a plurality of modular blocks comprising the coil assembly wherein a top and bottom block include the turns.

23. The method as defined in claim 18 wherein the fastening comprises utilizing a spring washer as the fastener.

* * * * *